US006642466B1

(12) United States Patent
Lu

(10) Patent No.: US 6,642,466 B1
(45) Date of Patent: Nov. 4, 2003

(54) BRIDGE STRUCTURE FOR KEYBOARDS

(75) Inventor: Kevin Lu, Hsin-Tien (TW)

(73) Assignee: Shin Jiuh Corp., Hsin-Tien (TW)

( * ) Notice: Subject to any disclaimer, the term of this patent is extended or adjusted under 35 U.S.C. 154(b) by 44 days.

(21) Appl. No.: 10/078,700

(22) Filed: Feb. 21, 2002

(51) Int. Cl.[7] ..... H01H 13/70
(52) U.S. Cl. ..... 200/344
(58) Field of Search ..... 200/5 A, 517, 200/344, 345; 400/490, 491, 491.2, 495, 495.1, 496

(56) References Cited

U.S. PATENT DOCUMENTS 5,630,501 A * 5/1997 Tsay ..... 200/344
5,842,798 A * 12/1998 Su ..... 400/491.2
6,268,578 B1 * 7/2001 Nakai ..... 200/520
6,392,176 B1 * 5/2002 Tsai ..... 200/344
6,550,993 B2 * 4/2003 Lu et al. ..... 400/490

* cited by examiner

*Primary Examiner*—Michael Friedhofer
(74) *Attorney, Agent, or Firm*—Birch, Stewart, Kolasch & Birch, LLP

(57) ABSTRACT

An improved bridge structure for keyboards consists of a first linkage element and a second linkage element pivotally engaging with each other. The first linkage element and second linkage element have respectively a pivotal trough which have respectively a pivotal trough slant surface section on the bottom section, and an axle which have respectively an axle slant surface section on the bottom section. The two slant surface sections intersect to form a fulcrum. The fulcrums remain stationary at the center to serve as the circle center of movements such that moving tolerances are unchanged when the key cap is depressed downwards. And the movements are performed based on the stationary center points which support and transfer forces in sideward directions to reduce sideward inclination and shaking.

4 Claims, 6 Drawing Sheets

BRIDGE STRUCTURE FOR KEYBOARDS

FIELD OF THE INVENTION

The present invention relates to an improved bridge structure for keyboards and particularly to a bridge structure for reducing sideward inclination angle and shaking.

BACKGROUND OF THE INVENTION

A conventional bridge structure (as shown in FIGS. 1A through 1D) used in notebook computers generally consist of a first linkage element 1 and a second linkage element 2 which have respectively a leg section 11, 21. The leg sections 11, 21 have respectively a symmetrical first axle 12, 22 located on two sides thereof to pivotally engage with a latch section on a base, and connect two symmetrical arms 14, 24. There is an opening 15, 25 formed between each pair of arms 14, 24. On each of the arms 14, 24, there is a pivotal connecting section 16, 26. The pivotal connecting section 16, 26 have respectively a pivotal tough 17, 27 and a pivotal axle 18, 28. The arms 14, 24 further have respectively a symmetrical second axle 10, 20 which are pivotally engaged with a latch section of a key cap.

When the first and second linkage element 1, 2 are leveled, the pivotal connecting sections are completely matched and coupled. However, when the key cap is lifted by an elastic element, the position of the fulcrum also is raised along the changes of the angle. The movements incur a greater tolerance among the moving elements. When the key cap is depressed, there is no strong supporting point to transfer sideward pressure resulting from downward pressure the key cap received. Hence the key cap tends to tilt and shake at a greater angle when being pressed downwards. It could even cause the first and second linkage element to separate on the engaging location, or result in shaking or loosening off of the key cap.

SUMMARY OF THE INVENTION

The primary object of the invention is to resolve aforesaid disadvantages. The invention provides an improved bridge structure to reduce sideward inclination angle and shaking during operations.

To achieve the foregoing object, the invention includes a first and a second linkage element which have respectively two arms each has a pivotal connecting section. The pivotal connection section includes a pivotal trough and an axle. The pivotal trough has a first slant surface section on the bottom section thereof, and the axle has a second slant surface section on the bottom section thereof. The first and second slant surface sections intersect on a juncture to form a fulcrum. When the key cap is lifted by an elastic element, the fulcrum functions as a stationary center point and also as the center of a circle to allow related elements moving about the fulcrum at various angles. Moving tolerances can be maintained without enlarging. When the key cap is depressed, the stationary center point can transfer sideward forces resulting from the downward pressure received on the key cap. Hence sideward inclination angle and shaking can be effectively reduced.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1A:
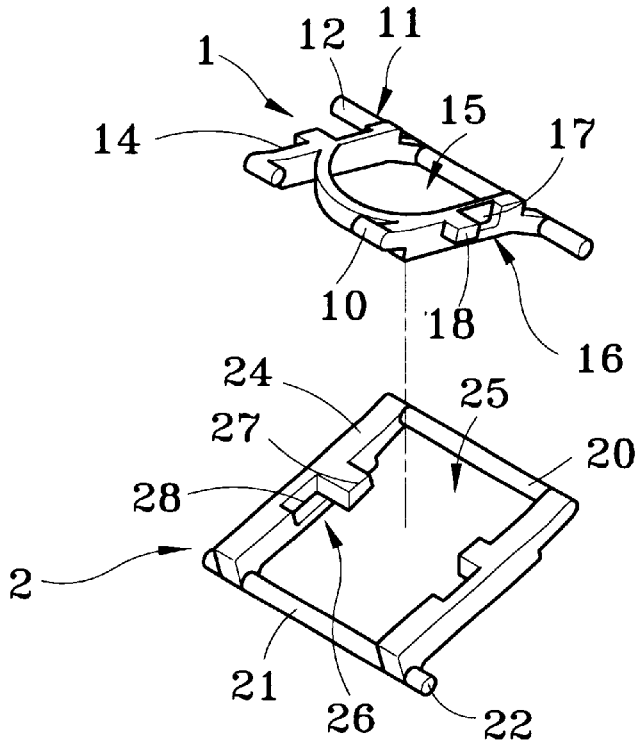
Fig.1A PRIOR ART
FIG. 1A an exploded view of a conventional bridge.
Figure 1B:
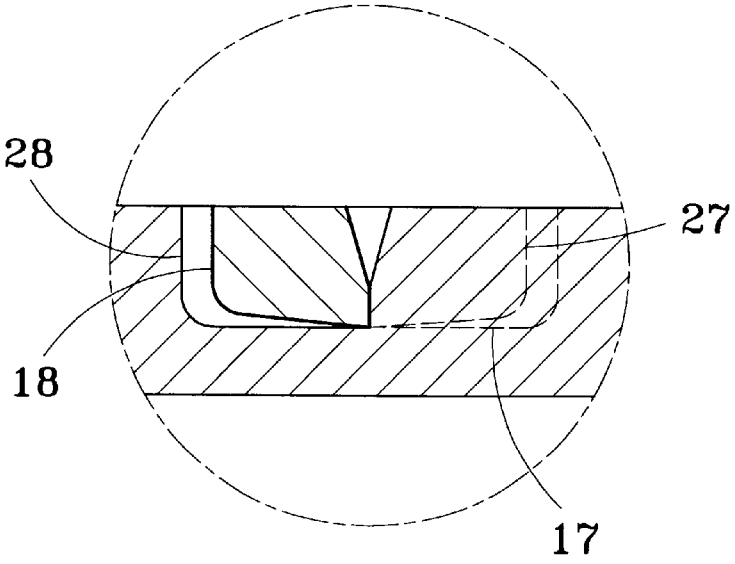
Fig.1B PRIOR ART
FIGS. 1B through 1D are fragmentary enlarged views according to FIG. 1A, showing various moving conditions.
Figure 1C:
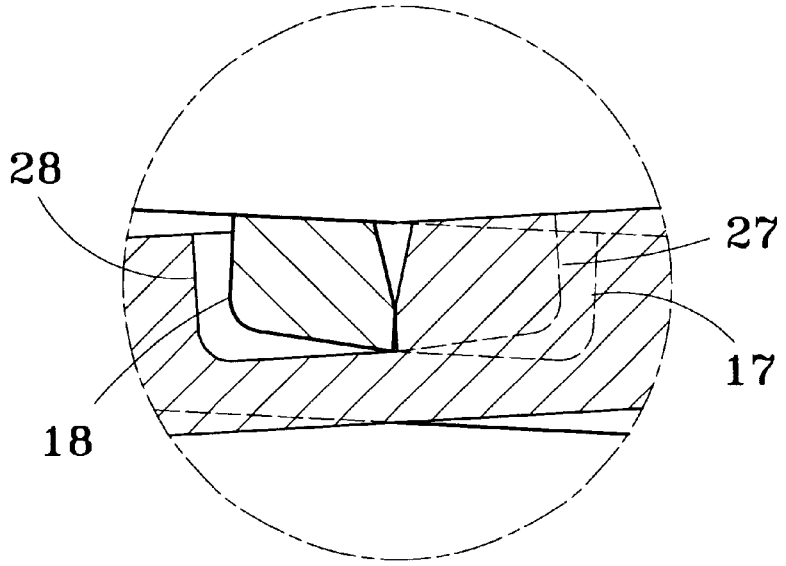
Fig.1C PRIOR ART
Figure 1D:
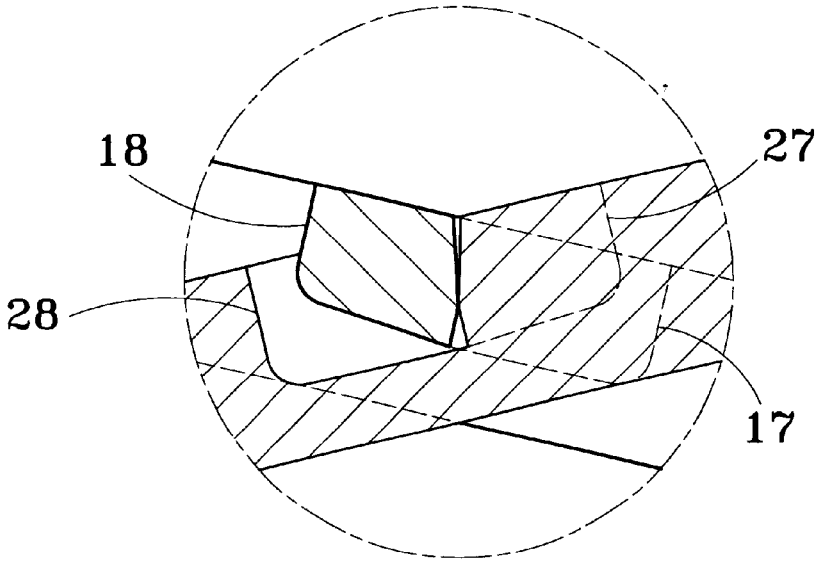
Fig.1D PRIOR ART
Figure 2:
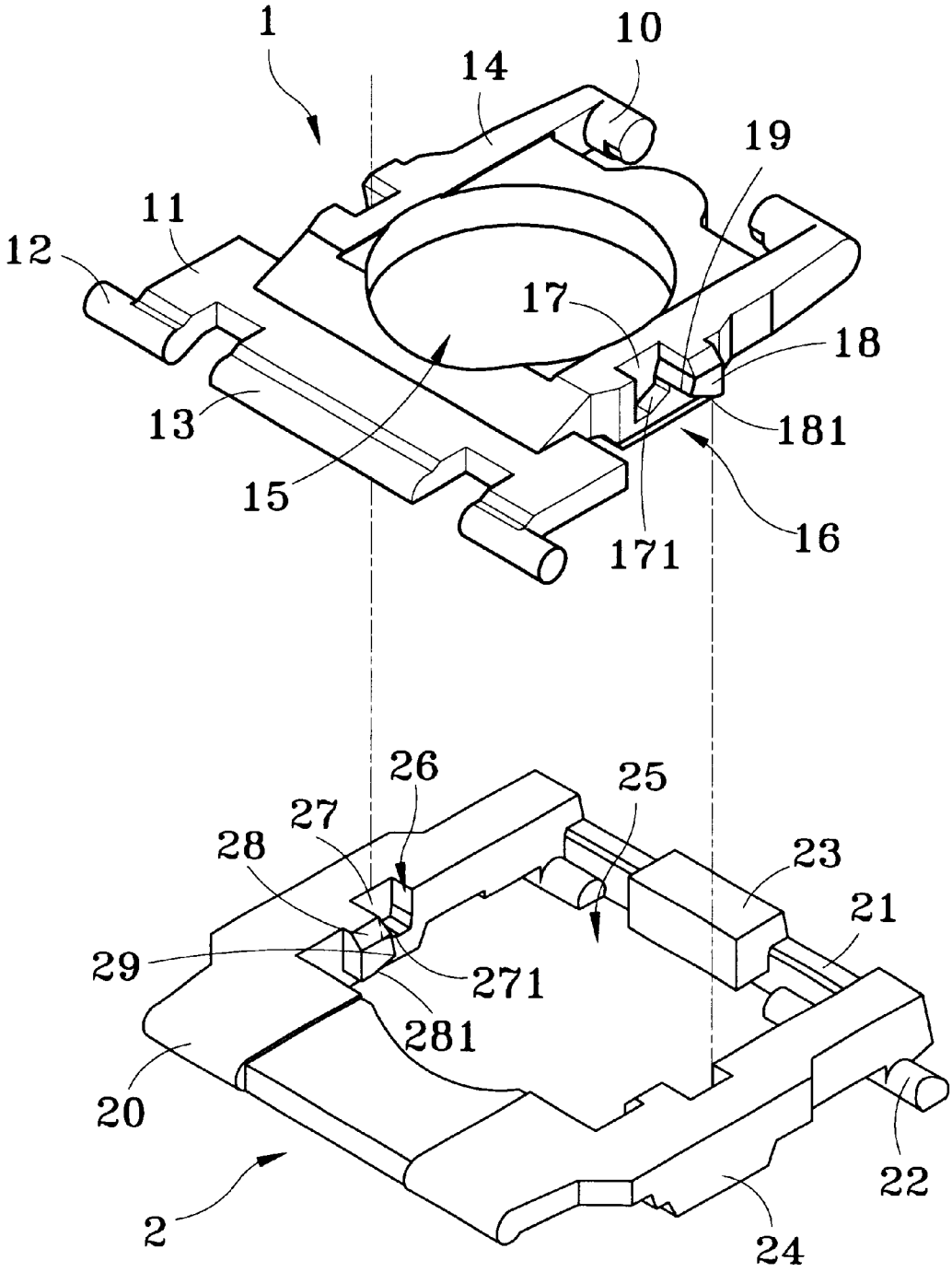
FIG. 2 is an exploded view of the invention.
Figure 3A:
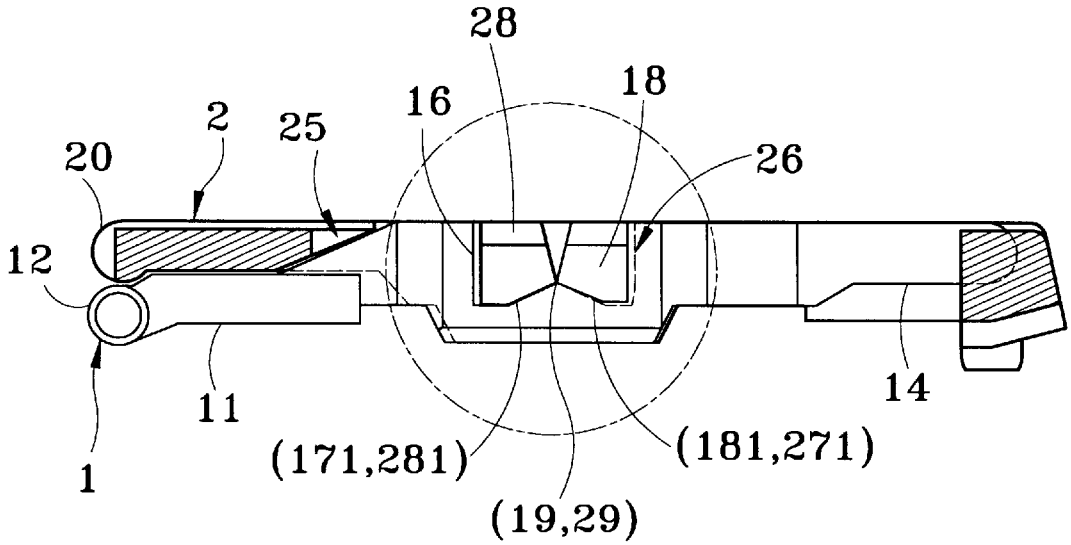
FIG. 3A is a schematic view of the bridge of the invention, assembled.
Figure 3B:
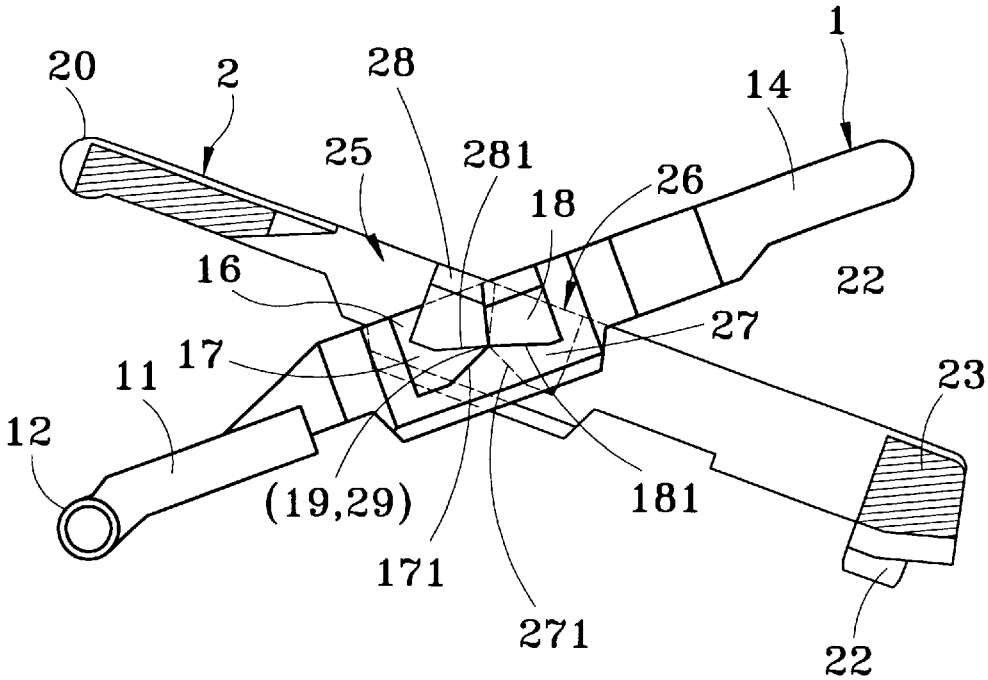
FIG. 3B is a schematic view of the bridge of the invention, in a pivotal moving condition.
Figure 3C:
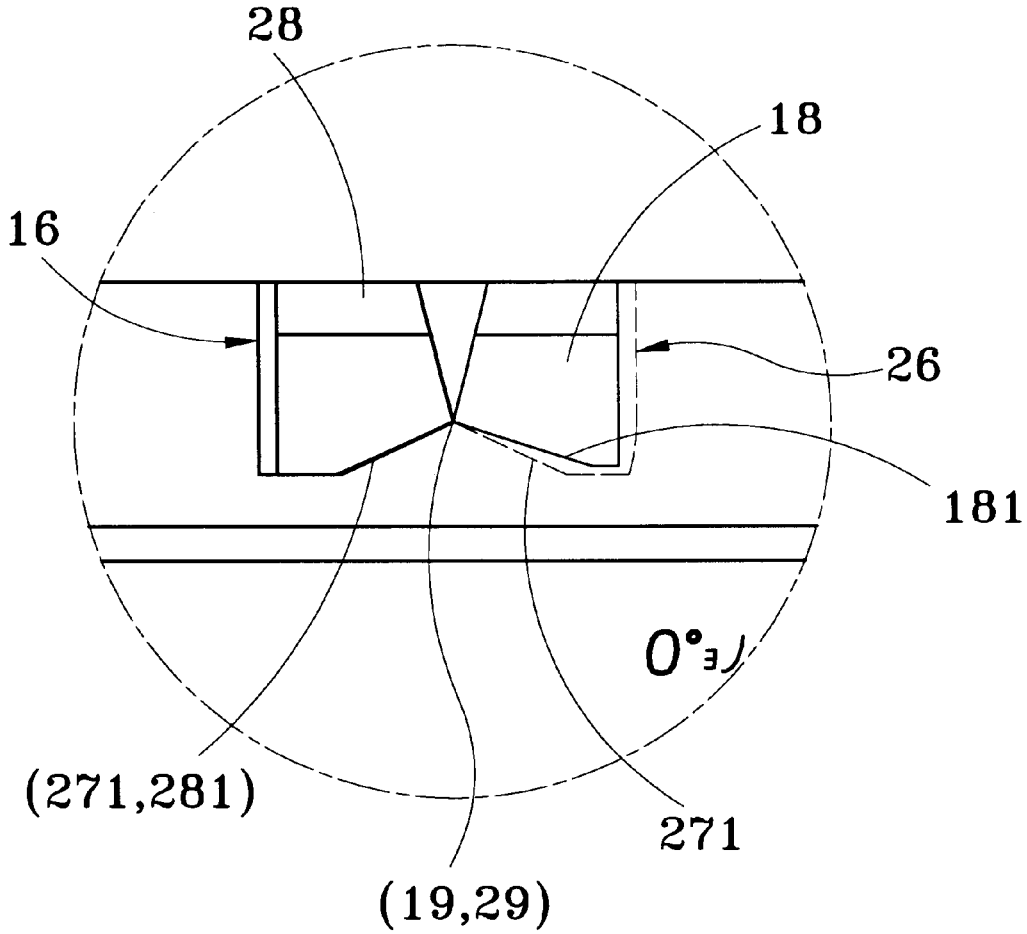
FIGS. 3C through 3E are fragmentary enlarged views according to FIG. 3A, showing various moving conditions.
Figure 3D:
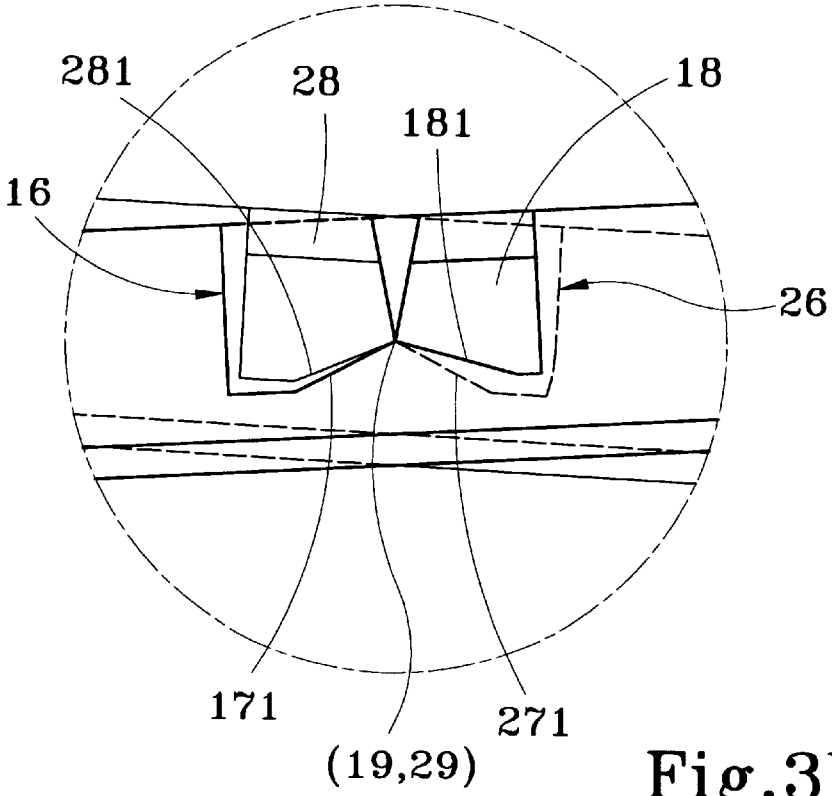
Figure 3E:
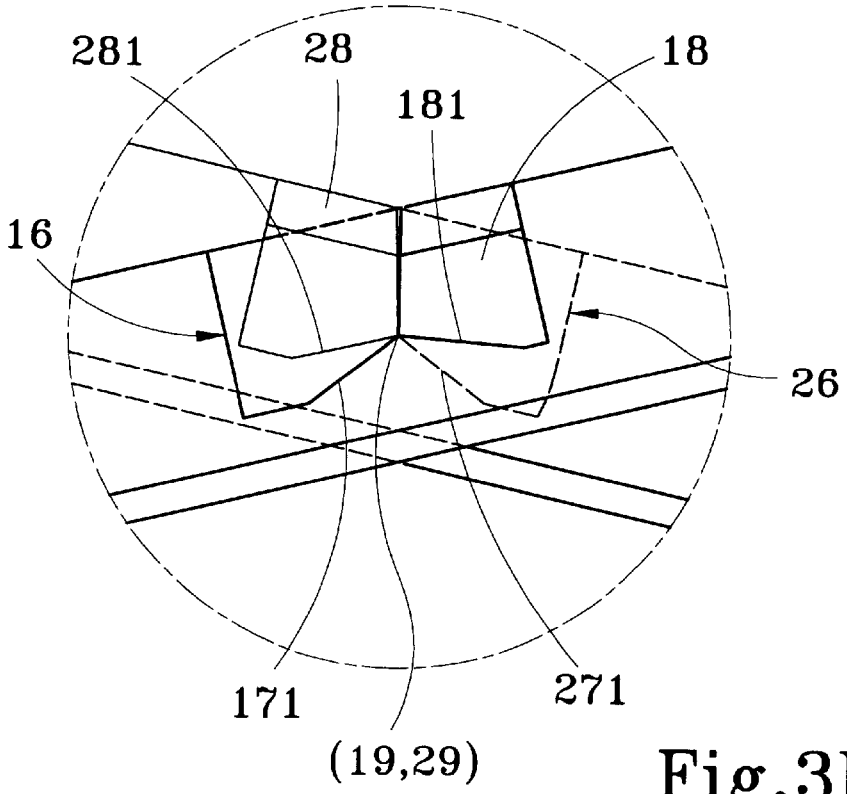

Referring to FIG. 2, the bridge structure of the invention consists of a first linkage element 1 and a second linkage element 2 pivotally engaging with each other and is located between a base (not shown in the drawing) of a keyboard and a key cap (also not shown in the drawing) for supporting the up and down movements of the key cap.

The first linkage element 1 has a first leg section 11 which has two symmetrical first axles 12 located on two sides thereof to pivotally engage with a latch section (not shown in the drawing) on the base. The first leg section 11 further has a first jutting section 13 to engage with a bucking section (not shown in the drawing) of the base, and two symmetrical first arms 14 on two sides. The two first arms 14 form a first opening 15 therebetween for an elastic element (not shown in the drawing) to pass through. Each first arm 14 has a first pivotal connecting section 16 which includes a first pivotal trough 17 and a first axle 18. The first pivotal trough 17 has a first trough slant surface section 171 on the bottom thereof, and the first axle 18 has a first axle slant surface section 181 on the bottom thereof. The first trough slant surface section 171 and the first axle slant surface section 181 intersect on a juncture to form a first fulcrum 19. The two first arms 14 have another end to form a pair of symmetrical first stub shafts 10 to pivotally engage with a latch section (not shown in the drawing) of the key cap.

The second linkage element 2 has a second leg section 21 which has two symmetrical second axles 22 located on two sides thereof to pivotally engage with another latch section (not shown in the drawing) on the base. The second leg section 21 further has a second jutting section 23 and two symmetrical second arms 24 on two sides. The two second arms 24 form a second opening 25 therebetween to allow the elastic element and the first linkage element 1 to pass through. Each second arm 24 has a second pivotal connecting section 26 which includes a second pivotal trough 27 and a second axle 28. The second pivotal trough 27 has a second trough slant surface section 271 on the bottom thereof, and the second axle 28 has a second axle slant surface section 281 on the bottom thereof. The second trough slant surface section 271 and the second axle slant surface section 281 intersect on a juncture to form a second fulcrum 29. The two second arms 24 have another end to form a pair of symmetrical second stub shafts 20 to pivotally engage with a latch section (not shown in the drawing) of the key cap.

Referring to FIGS. 3A through 3E for the bridge structure of the invention in assembly and operating conditions, to assemble the bridge structure, move the first linkage element 1 through the second opening 25 of the second linkage element 2, and engage the first axle 18 of the first linkage element 1 with the second pivotal trough 27 of the second linkage element 2, and engage the second axle 28 of the second linkage element 2 with the first pivotal trough 17 of the first linkage element 1. When the first and second linkage elements 1, 2 are disposed in a leveled manner, the first and second axles 18, 28 are coupled completely. When the elastic element (not shown in the drawings) lifts the key cap (also not shown in the drawings), the first and second fulcrums 19, 29 of the first and second linkage elements 1, 2 remain stationary and serve as the circle center of the movements. Moving tolerances do not increase when the linkage elements are moved to various angles. When the key cap is depressed downwards, the downward movement also is performed based on the stationary center point to support and transfer forces in sideward directions. Thus sideward inclination and shaking can be effectively reduced. Thereby the first and second linkage elements 1, 2 can effectively support upward and downward movements of the key cap without incurring separation on the juncture, and the key cap can be securely held without shaking or loosening off.

What is claimed is:

1. An improved bridge structure for a keyboard comprising a first linkage element and a second linkage element pivotally engaging with the first linkage element and being located between a base of the keyboard and a key cap and having an elastic element located in the first linkage element for supporting up and down movements of the key cap, wherein:

the first linkage element has two first arms each having a first pivotal connecting section which includes a first pivotal trough and a first axle, the first pivotal trough having a first trough slant surface section on a bottom thereof, the first axle having a first axle slant surface section on a bottom thereof, the first trough slant surface section and the first axle slant surface section being intersected on a juncture to form a first fulcrum;

the second linkage element has two second arms each having a second pivotal connecting section which includes a second pivotal trough and a second axle, the second pivotal trough having a second trough slant surface section on a bottom thereof, the second axle having a second axle slant surface section on a bottom thereof, the second trough slant surface section and the second axle slant surface section being intersected on a juncture to form a second fulcrum;

wherein when the elastic element lifts the key cap the first and the second fulcrum remain stationary at a center point to serve as a circle center of movements such that moving tolerances remain unchanged without increasing when the key cap is depressed downwards, the movements being performed based on the stationary center point which supports and transfers forces in sideward directions to reduce sideward inclination and shaking.

2. The improved bridge structure for a keyboard of claim 1, wherein the first and the second linkage element have respectively a first and a second leg section which have respectively symmetrical first axles and second axles located on two sides thereof, and have respectively a first jutting section and a second jutting section.

3. The improved bridge structure for a keyboard of claim 1, wherein each pair of the first and the second arms are symmetrical and connect respectively a first and a second leg section, the first and second arms also form respectively a first and a second opening therebetween.

4. The improved bridge structure for a keyboard of claim 1, wherein the first and the second arms of the first and second linkage element have respectively a first and a second symmetrical stub shaft located on one end thereof.

* * * * *